US006742307B2

(12) United States Patent
Briskman

(10) Patent No.: US 6,742,307 B2
(45) Date of Patent: Jun. 1, 2004

(54) ADJUSTABLE CUBICLE SYSTEM

(76) Inventor: Ross Adam Cole Briskman, 26 Douglas Rd., Chappaqua, NY (US) 10514

( * ) Notice: Subject to any disclaimer, the term of this patent is extended or adjusted under 35 U.S.C. 154(b) by 0 days.

(21) Appl. No.: 10/075,414

(22) Filed: Feb. 14, 2002

(65) Prior Publication Data

US 2003/0150180 A1 Aug. 14, 2003

(51) Int. Cl.[7] ..... E04H 1/00

(52) U.S. Cl. ..... 52/36.1; 52/36.4; 52/239; 108/60

(58) Field of Search ..... 52/239, 220.7, 52/36.4, 36.5, 481.2, 36.1; 312/245, 246, 205; 108/60; 211/184

(56) References Cited

U.S. PATENT DOCUMENTS 2,596,663 A * 5/1952 Duffy ..... 108/69
3,181,920 A * 5/1965 Burr ..... 108/11
5,287,666 A * 2/1994 Frascaroli et al. ..... 52/239
5,375,802 A 12/1994 Branham, II
5,428,928 A 7/1995 Hellwig et al.
5,852,904 A * 12/1998 Yu et al. ..... 52/220.7
6,076,317 A * 6/2000 Hellwig et al. ..... 52/239
6,161,347 A 12/2000 Yu et al.

* cited by examiner

*Primary Examiner*—Carl D. Friedman
*Assistant Examiner*—Naoko Slack
(74) *Attorney, Agent, or Firm*—Jack Schwartz & Assocs.

(57) ABSTRACT

The present invention recites a system for forming individual work areas within an open area. The system includes a spine wall extending vertically from a surface of the open area. A first work surface extends along and substantially perpendicular to one side of the spine wall. The first work surface has a length substantially equal to a length of the spine wall. A divider wall is positioned atop the first work surface and releasably connected to the spine wall at any point along the length of the spine wall for forming cubicles of desired size. An extension wall is releasably connected to the dividing wall for extending an area of cubicles formed on either side of the dividing wall.

29 Claims, 17 Drawing Sheets

ADJUSTABLE CUBICLE SYSTEM

BACKGROUND OF THE INVENTION

1. Field of the Invention

The present invention relates to office furnishing systems, and more particularly to a cubicle system including a continuous work surface extending uninterrupted horizontally along a length of a spine wall and a plurality of divider panels adjustably positioned at any point along a top of the work surface and releasably secured to the spine wall for readily, quickly and inexpensively adjusting a size for cubicles formed by the system. Additional related accessories may be secured at any point along the length of the spine wall as well.

2. Description of the Prior Art

In recent times ever more widespread use has been made in modem offices of partition walls constituted by modular elements that can be assembled in various possible configurations and used to divide an open area into several separate workspaces. The partition walls usually extend from the floor at least part way to the ceiling of the area in which they are fitted and may be equipped with auxiliary elements such as bookshelves, suspended fittings or cupboards attached to the walls. The main advantage of the use of such partition walls lies in the fact that the space available can be partitioned fairly quickly and easily and the elements originally used in one location can be re-used to furnish a different location. However, these walls are not very flexible in their use. The furnishing of an area partitioned by these walls is modified by re-hiring an installation team to breakdown the existing system and re-install it, after its initial fitting-out. Additionally, these cubicle systems are able to convert large open areas within an office into useable office work space.

A similar development, parallel to that indicated above, has also taken place in the field of office work-station furnishings (desks, boardroom tables, work surfaces for typists, etc.). In this field, it has also been proposed to use furnishing systems that provide for the assembly of modular elements in various possible configurations so as to fulfill the needs for ease, rapidity and flexibility of assembly.

Hitherto, separate modular furnishing systems have been proposed for partition walls and for screens and workstations respectively. In some cases, integrated modular systems have also been proposed and provide both partition walls and screens. Known modular-furnishing systems usually have a combined desk and paneling system, which provides an effective means for subdividing office space and defining work areas. Various prior patents show work surfaces positioned within areas divided by the paneling system. Certain of these systems provide for power and communication wires and cables to be distributed throughout the desk and paneling systems by running the wires and cables through the walls.

Examples of adjustable cubicle systems such as discussed above have been provided in the prior art. For example, U.S. Pat. Nos. 5,375,802; 5,428,928; 5,852,904; 6,076,317 and 6,161,437 all are illustrative of such prior art and are discussed hereinbelow.

This invention relates to a space-dividing wall panel system having a plurality of base panels that are serially connectable one with the other to define a vertically enlarged wall supported on a floor. Each base panel is defined by at least one horizontal box-beam rigidly connected to a pair of laterally spaced apart vertical uprights, which are connected at the opposite ends of the box-beam and have a reduced thickness compared thereto. With this clearance between the faces of the box-beam and the uprights, the box-beam, cross rails at the ends of the uprights as well as additional extension panels are formed with longitudinally extending channels which are positioned free of interference with the vertical uprights and aligned with serially-adjacent channels of serially-adjacent wall panels. The channels provide a continuous linear track on the opposite sides of the upright which permit the connection of mounting hooks of furniture components and permit continuous, uninterrupted sliding or adjustment of the furniture components along the entire length of the aligned channels.

This invention relates to workstations that use a combination of office panels and bridge arrangements that are attached to and project at an angle from a spine of office panels. The office panel frames that partially define a workstation provide the convenience of power and communication cabling within the panel frames. The bridge arrangements provide a lower cost alternative defining other walls of the workstation while also providing a system that can be rearranged easily. The bridge arrangements are preferably self supporting in an upright orientation and can easily be detached from a horizontal securing channel of an office panel frame and moved to a new position.

This invention relates to a space-dividing wall panel system having a plurality of base panels that are serially connectable one with the other to define a vertically enlarged wall supported on a floor. Each base panel is defined by at least one horizontal box-beam rigidly connected to a pair of laterally spaced apart vertical uprights, which are connected at the opposite ends of the box-beam and have a reduced thickness compared thereto. With this clearance between the faces of the box-beam and the uprights, the box-beam, cross rails at the ends of the uprights as well as additional extension panels are formed with longitudinally extending channels which are positioned free of interference with the vertical uprights and aligned with serially-adjacent channels of serially-adjacent wall panels. The channels provide a continuous linear track on the opposite sides of the upright which permit the connection of mounting hooks of furniture components and permit continuous, uninterrupted sliding or adjustment of the furniture components.

This invention relates to a combined desking and paneling system, which provides an effective means for subdividing office space and defining work areas. Work surfaces are provided and can be independently supported or supported by the paneling system. Power and communication wires and cables are distributed through and between the desking and paneling systems.

This patent discloses a structural assembly for fastening together and disengaging a slotted supporting unit and a supported unit having adjustable gripping means mounted thereon co-operable with the slotted supporting unit to apply compressive forces to the supporting unit and resulting tensile forces to the supported unit in order to maintain the fastened together units facing planar relationship.

The above-described systems are able to divide an open area into a plurality of cubicle shaped workspaces. However, these systems can be awkward and clumsy while also not being easily assembled, altered or disassembled. Reconfiguration of prior systems typically requires complete or near complete dismantling. These systems create cubicles which are all of uniform size and require additional elements in order to provide a ready to use work space. While these units may be suitable for the particular purpose to which they address, they would not be as suitable for the purposes of the present invention as heretofore described.

It is thus desirable to provide an adjustable cubicle system including a continuous work surface extending along a length of a spine wall of the system. It is further desirable to provide an adjustable cubicle system including at least one dividing panel able to be selectively secured to the spine wall at any desired position therealong and extending perpendicularly thereto. It is still further desirable to provide an adjustable cubicle system wherein the dividing panel is able to be readily adjusted to produce cubicles of any desired size. It is even further desirable to provide an adjustable cubicle system including a plurality of dividing panels, each selectively securable to any position along the length of the spine wall to produce a plurality of cubicles, each cubicle being of a desired size. It is yet further desirable to provide an adjustable cubicle system wherein the dividing panels are able to selectively slide along the work surface when adjusting a size of a cubicle without dismantling the existing parts. It is further desirable to provide an adjustable cubicle system including a continuous work surface extending along both sides of the spine wall. It is still further desirable to provide an adjustable cubicle system including at least one extension wall releasably securable to a dividing wall for increasing a size of the cubicle. It is even further desirable to provide an adjustable cubicle system wherein the extension wall includes a work surface extending therealong and at a height so as to be able to mate with the work surface extending along the spine wall. It is yet further desirable to provide an adjustable cubicle system wherein the extension wall includes a mounting bracket for a monitor for connection with a computer processor. It is desirable to also have light fixtures recessed or surface mounted in this extension for desktop video conferencing. It is still further desirable to provide an adjustable cubicle system wherein cables and wires are able to extend within the extension and divider walls for providing an electrical connection within each cubicle formed by the system. It is even further desirable to provide an adjustable cubicle system including a selectively retractable screen stored within the extension wall and in an extended position being selectively securable to another extension wall to create an enclosed cubicle providing privacy to a user or storage space. It is also desirable to have overhead storage units that are either opened, like a shelf, or closed, like a cabinet that are mounted on a wall of the cubicle system. It is even further desirable for the overhead storage units to have a variable length which is easily adjustable.

SUMMARY OF THE INVENTION

The present invention relates to office furnishing systems, and more particularly to a cubicle system including a work surface extending horizontally along a length of a spine wall and a plurality of divider panels adjustably positioned at any point along a top of the work surface and secured to the spine wall for readily adjusting a size for cubicles formed by the system without dismantling the system.

A primary object of the present invention is to provide an adjustable cubicle system that will overcome the shortcomings of prior art devices.

The object of the present invention is to improve on previously known workstation cubicle systems by making their assembly easier, quicker and more flexible, as well as to provide a user with work spaces of a desired size which are easily and readily adjustable.

More particularly, this invention is based on a specific configuration of workstation furniture systems for use in an "open office environment" (also referred to as "landscape furniture environment"). The workstation configuration is created by using a common "center spine". On at least one and preferably both sides of the center spine is a continuous work surface extending the length of and secured to the center spine. The center spine is formed from at least one vertically standing furniture panel. Alternatively, the center spine may be formed from a plurality of furniture panels fastened in tandem, creating a cubicle system of any desired length. Preferably, the cubicle system will be at least substantially 10 feet long at a minimum so that a plurality of cubicles may be formed on either side of the spine wall. Unlike typical "off modular" furniture systems currently on the market, the work surface is of a uniform height and uninterrupted along the length of the spine wall.

One inventive aspect of the present invention is the ability of the end user to change the size of a cubicle or workstation area without hiring an installation team or dismantling or moving multiple parts including the center spine or work surface. The end user or facility manager simply releases and slides a dividing panel along the work surface extending along the length of the center spine until a subdivided space of a desired width is obtained. At this point the dividing wall is positioned on the work surface and extends perpendicular to the center spine. The dividing wall is then releasably secured to the center spine. An extension wall may be positioned alongside and releasably secured to the dividing wall to extend the size of the work area or cubicle. The extension wall is selectively separated from the divider wall and can be moved with the divider wall when resizing a cubicle.

An object of the present invention is to provide an adjustable cubicle system including a single work surface extending along a length of a spine wall of the system.

Another object of the present invention is to provide an adjustable cubicle system including at least one dividing panel able to be selectively secured to the spine wall at any desired position therealong and extending perpendicularly thereto.

A still further object of the present invention is to provide an adjustable cubicle system wherein the dividing panel is able to be readily adjusted to produce cubicles of any desired size using minimal effort.

An even further object of the present invention is to provide an adjustable cubicle system including a plurality of dividing panels, each selectively securable at any point along the length of the spine wall to produce a plurality of cubicles, each cubicle being of a desired size, wherein the size of a cubicle is only limited by the length of the center spine.

A yet further object of the present invention is to provide an adjustable cubicle system wherein the dividing panels are able to selectively slide along the work surface when adjusting a size of a cubicle.

A further object of the present invention is to provide an adjustable cubicle system wherein a continuous and uninterrupted work surface extends along both sides of the spine wall.

A still further object of the present invention is to provide an adjustable cubicle system including at least one extension wall releasably secured to a dividing wall for increasing or decreasing the size of a cubicle formed by the dividing wall(s) and spine wall.

An even further object of the present invention is to provide an adjustable cubicle system wherein the extension wall includes a work surface extending therealong at a height so as to mate with the work surface extending along the spine wall.

A yet further object of the present invention is to provide an adjustable cubicle system wherein the extension wall includes a mounting bracket for a monitor for connection with a computer processor positioned within the cubicle.

An even further object of the present invention is to provide an adjustable cubicle system wherein the extension wall includes a recess for lighting fixtures that are appropriate for video conferencing.

A still further object of the present invention is to provide an adjustable cubicle system wherein cables and wires extend along raceways extending below the work surface for providing power to each cubicle formed by the system.

An even further object of the present invention is to provide an adjustable cubicle system including a selectively retractable screen stored within the extension wall and in an extended position being selectively securable to another extension wall to create an enclosed cubicle providing visual privacy to a user or storage space.

A still further object of the adjustable cubicle system of the present invention is that the instant system has an extension wall which sits on the floor and is built as a "freestanding" furniture component. The extension wall may include any or all of built in pedestal files for ballast (to avoid tipping over), a work surface on one or both sides, and a vertically extending panel which connects to the dividing panel.

The extension wall can be configured in various ways to add to utility and make it unique including adding storage components to it such as a retractable screen able to be releasably secured to another extension wall for creating an enclosed cubicle for private use or storage.

Another object of the present invention is to provide an adjustable cubicle system that is simple and easy to use and modify.

A still further object of the present invention is to provide an adjustable cubicle system that is economical in cost to manufacture.

Additional objects of the present invention will appear as the description proceeds.

Using the adjustable cubicle system described herein, a manufacturer can provide a single modular construction system for the complete furnishing of an office, which can be easily modified at anytime. The design and construction of the system are thus rationalized and simplified. The storage of the components of the system is also simplified since the number and types of components needed to form all the furnishing elements is reduced to a minimum. Finally, the system, which has work surfaces extending from one or both sides of a center spine, includes selectively adjustable dividing walls and extension walls for dividing the area of the work surface into cubicles of desired size. One of the main advantages of the adjustable cubicle system of the present invention is that the various components can be integrated harmoniously with each other and existing products in a functional yet aesthetically pleasing style. The speed and flexibility of assembly in constructing or disassembling the adjustable cubicle system of the present invention enables available space to be transformed more quickly and at lower cost than existing systems.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE INVENTION

Figure 1:
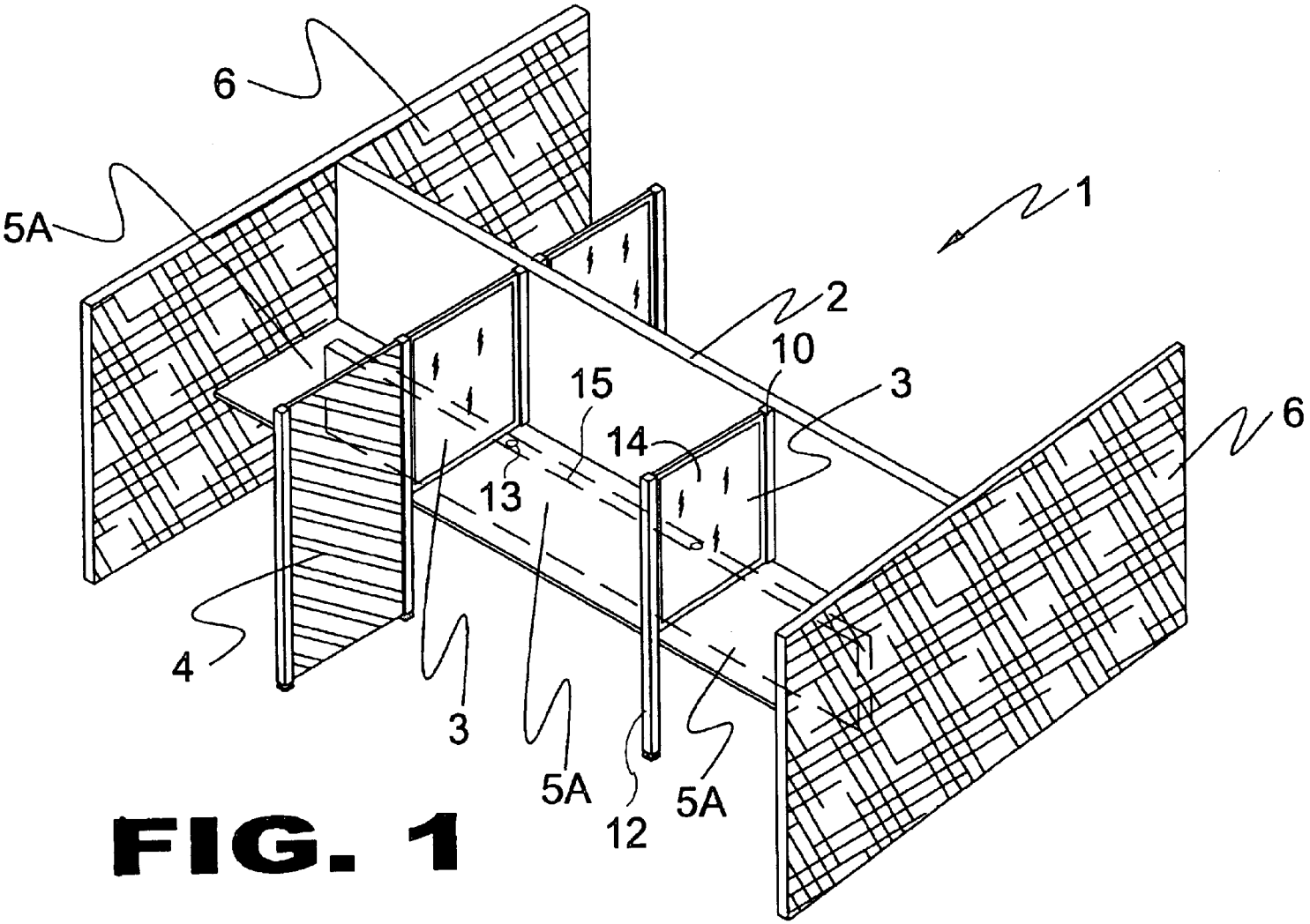
FIG. 1 illustrates a perspective view of the adjustable cubicle system of the present invention.

Turning now descriptively to the drawings, in which similar reference characters denote similar elements throughout the several views, FIGS. 1 through 14 illustrate the adjustable cubicle system of the present invention indicated generally by the numeral 1.

The adjustable cubicle system 1 is clearly shown in perspective view in FIG. 1. The adjustable cubicle system 1 includes a center spine wall 2 positioned between two end walls 6, one on either end side of the spine wall 2. A continuous work surface 5A is positioned on either side of the spine wall 2. The work surface 5A is continuous from end wall to end wall as it extends along the length of the spine wall 2 at a desired height above a floor surface. The work surface is preferably secured to the spine wall 2. However, the work surface 5A may be releasably attached to the spine wall 2. The work surface 5A is of substantially the same length and extends substantially perpendicular to the spine wall 2. The work surface 5A is supported at a desired height by the center spine wall 2. Additionally, the work surface 5A may be releasably secured to each of the end walls 6 to provide additional support. The center spine wall 2 may be formed from a single panel of a desired length. Alternatively, the center spine wall 2 may be formed from several panels fastened in tandem to create a cubicle system of a desired size. Preferably, the spine wall 2 will extend a length of at least 10 feet to thereby create a cubicle system which may accommodate a number of individually sized cubicles. The work surface 5A contains a continuous raceway 15 that is located on the underside thereof. The continuous raceway 15 provides an area for electrical wire and data wires to be neatly kept. The work surface 5A further contains recesses 13 extending therethrough whereby electrical and data wires stored in the continuous raceway 15 extend up through to the top of the work surface 5A for connection to their respective devices. The work surface 5A may alternatively be formed from a number of individual work surfaces able to be positioned in a flush relationship with one another to form a continuous work surface 5A. This will be described hereinbelow with specific reference to FIGS. 11 and 11A.

As is illustrated in FIG. 1, the work surface 5A is separated into three distinct work areas by dividing walls 3. The dividing walls 3 are provided to divide the system into a plurality of cubicles, each cubicle having a desired size independent of the other cubicles. The dividing walls 3 are seated atop the work surface 5A and are each releasably secured to the spine wall 2 at any position therealong. The dividing wall 3 is releasably connected to the spine wall 2 by a connection device 10. The connection device 10 is able to releasably secure the dividing wall 3 to any position along the length of the spine wall 2.

While a preferred structure for the connection device 10 is shown and described herein, those of ordinary skill in the art who have read this description will appreciate that there are numerous other structures for the connection device 10 and, therefore, as used herein the phrase "means for releasably securing said dividing wall to said spine wall" should be construed as including all such structures as long as they achieve the desired result of releasably securing the dividing wall 3 to the spine wall 2, and therefore, that all such alternative mechanisms are to be considered as equivalent to the one described herein.

Figure 4:
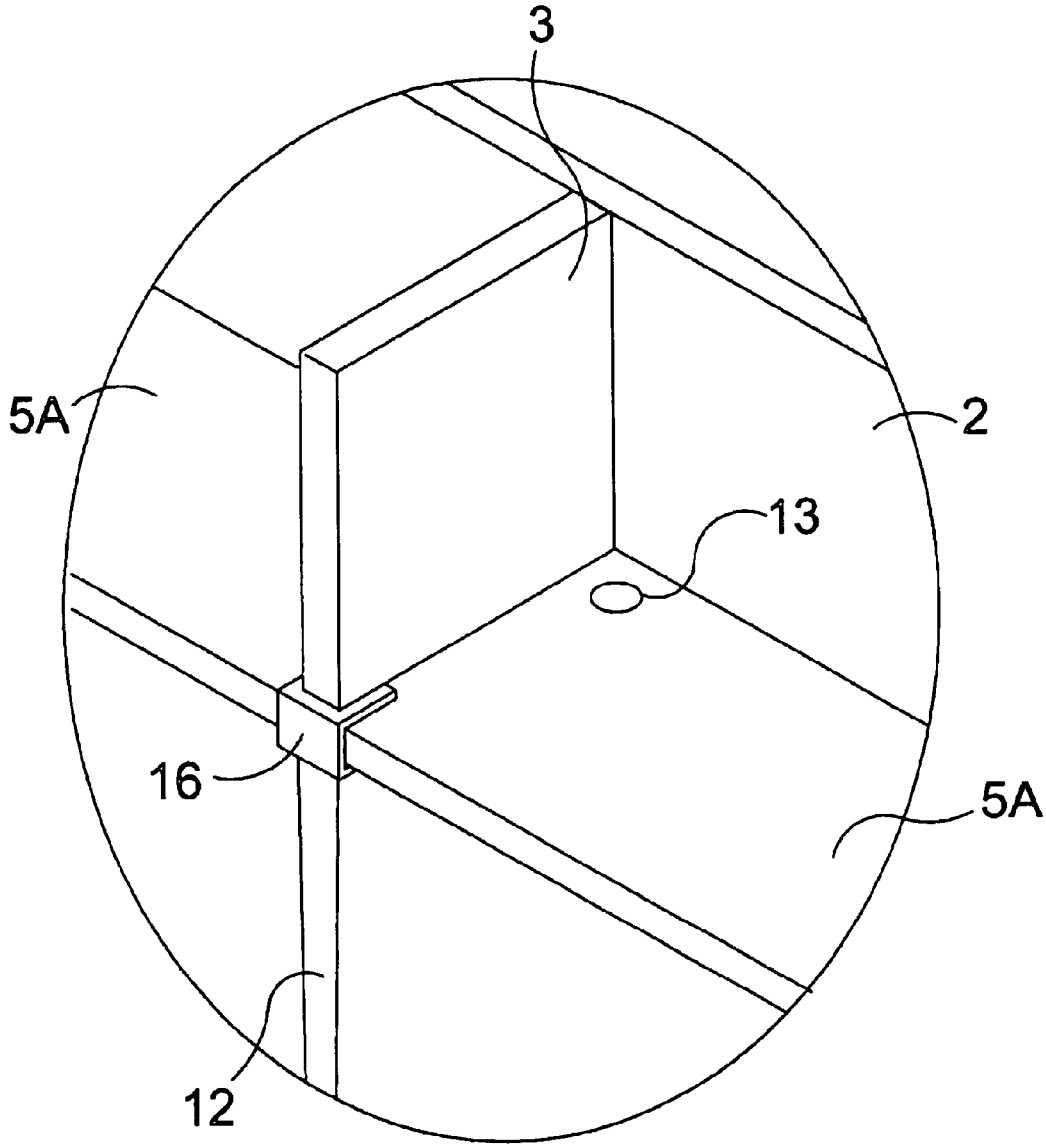
FIG. 4 illustrates a perspective view of an embodiment of a dividing wall used to form cubicles in the adjustable cubicle system of the present invention, the dividing wall being releasably clamped to the work surface and connected to a leg extending below the work surface.

One of the dividing walls 3 is releasably attached to an extension wall 4. The extension wall 4 serves to further define the boundaries of a cubicle. The extension wall 4 is connected to an edge of the dividing wall 3 and thereby extends the dividing wall 3 to a point beyond the work surface 5A. As can be seen the dividing wall 3 extends to a point substantially the same as the width of the work surface 5A and preferably includes a leg 12 extending from a wall portion 14 thereof to a floor surface on which the adjustable cubicle system 1 sits. In an alternative embodiment for the connection of leg 12 to the work surface 5A, leg 12 is permanently connected to a C-clamp 16 which when attached adds stability for work surface 5A as well as the dividing wall 3 as illustrated in FIG. 4. As can bee seen from FIG. 1, an additional dividing wall 3 is positioned on the opposite side of the spine wall 2, with each dividing wall independent of any other, thereby dividing the opposite side of the spine wall 2 into two cubicles.

Figure 2:
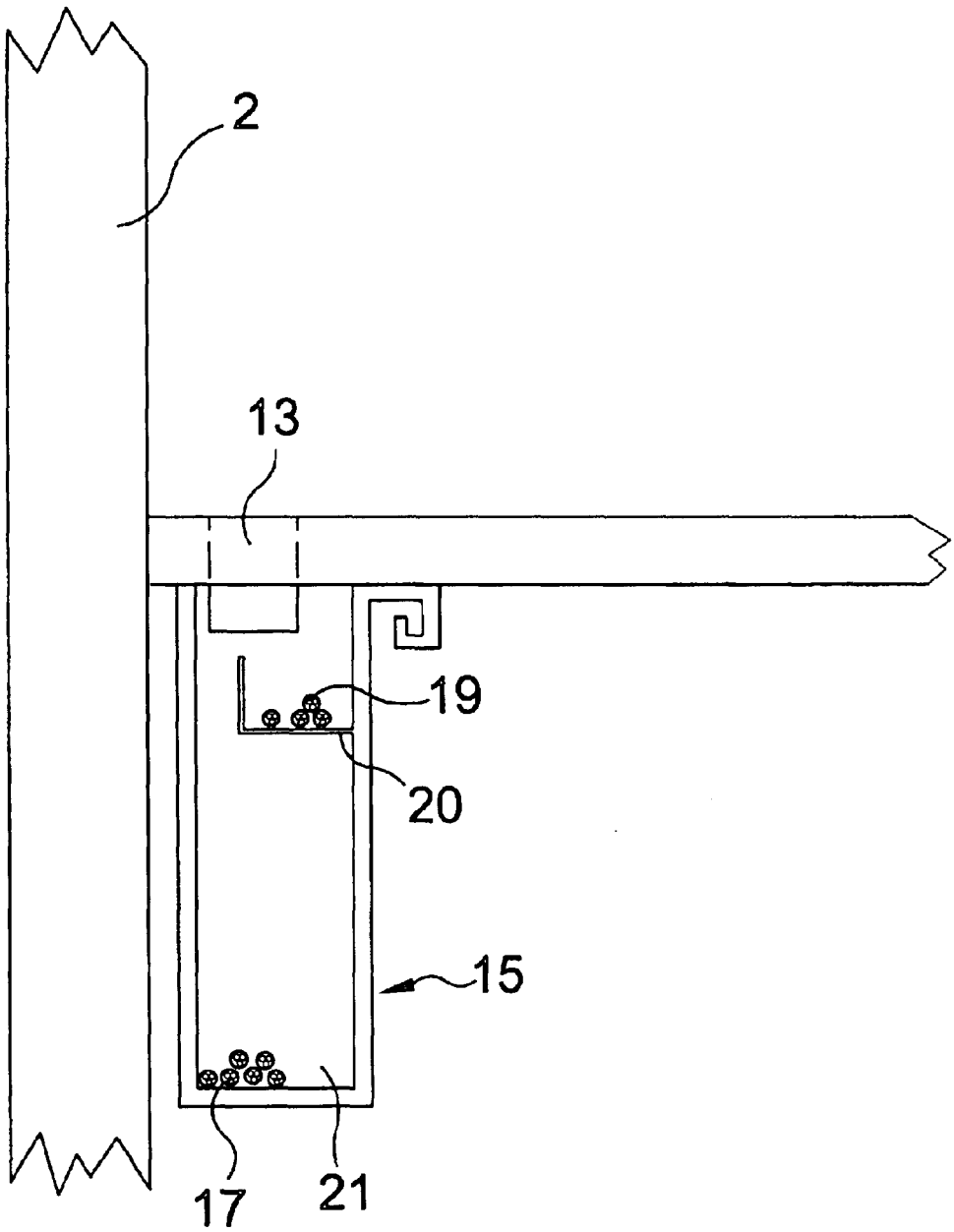
FIG. 2 illustrates a cross-sectional view of the worksurface of a cubicle of the adjustable cubicle system of the present invention.

FIG. 2 illustrates a cross section of the work surface 5A attached to the spine 2 of the adjustable cubicle system. FIG. 2 shows a top side of the work surface 5A and a bottom side of work surface 5A. Extending along the bottom side of work surface 5A is a continuous raceway 15. The continuous raceway 15 has two sub-raceways, a data raceway 21 and electrical raceway 20. The continuous raceway 15 functions to store both data cables 17 and electrical cables 19 neatly and separately. It is advantageous to separate the two cables to prevent any electrical corruption of data by electrical or magnetic field emanating from the electrical cables. The electrical cables 19 rest safely on the electrical raceway 20 whereas the data cables 17 rest on the data raceway 21. When many work surfaces 5A are connected to one another along the spine 2, the continuous raceways 15 located on the under side of each work surface 5A line up to form a single continuous raceway which provides a data connection and power for connection of different electrical devices or computers within each cubicle while keeping the work area neat and free from wires extending along the floors thereof.

Figure 3:
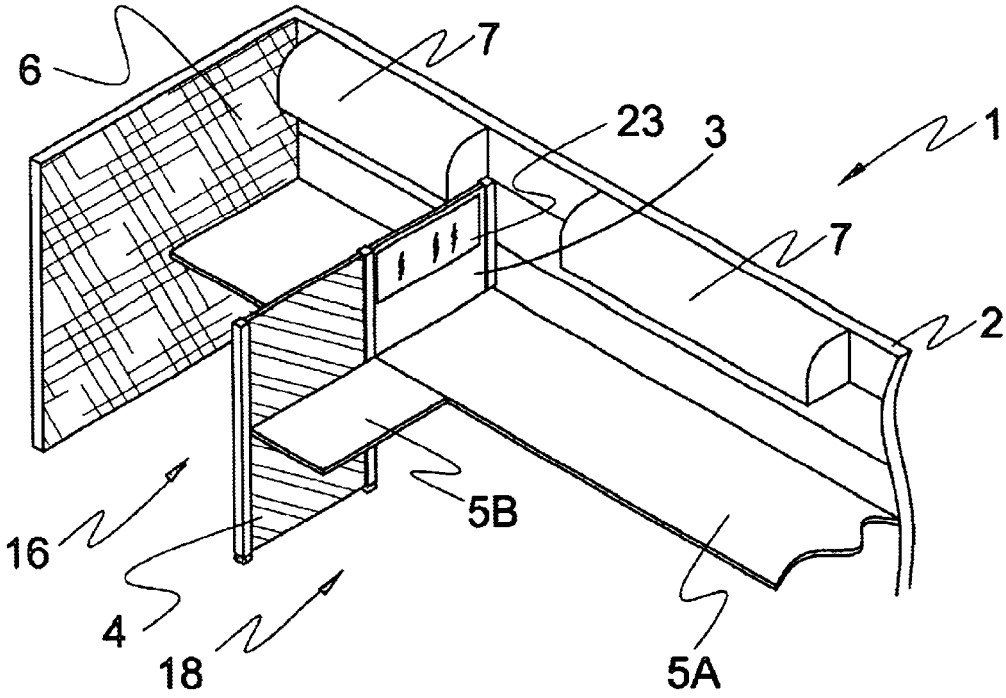
FIG. 3 illustrates a perspective view of the adjustable cubicle system of the present invention as illustrated in FIG. 1 wherein the position of the dividing wall is moved to adjust the size of the cubicles formed by the system.

FIG. 3 is similar to FIG. 1 illustrating the dividing wall 3 moved to a position whereby the first cubicle 16 is enlarged from the size shown in FIG. 2. The corresponding adjacent cubicle is thus reduced in size. The spine wall 2 is shown including the work surface 5A extending therealong. The dividing wall 3 is positioned to produce two cubicles, one on either side of the dividing wall 3. The first cubicle 16 is defined by the dividing wall 3 as well as one of the end walls 6 and is shown to be larger than as shown in FIG. 1. In order to increase the size of the first cubicle 16, the dividing wall 3 was released from its connection to the spine wall 2 and slid along the work surface 5A to a desired point. The dividing wall 3 was then resecured to the spine wall 2. The extension wall 4 is preferably released from its connection to the dividing wall 3 before extension wall 3 is moved. The extension wall 4 is reconnected to dividing wall 3 once the dividing wall 3 is resecured to the spine wall at the desired point along the spine. Upon increasing the size of the first cubicle 16, the size of the second cubicle 18 on the other side of the dividing wall 3 is decreased by an identical amount. The extension wall 4 is positioned on an edge of the dividing wall 3 to further separate and define the dimensions of the two cubicles. On a side of the extension wall 4 facing the second 18 of the two cubicles is the work surface 5B. The work surface 5B is preferably positioned at a height equal to the height of the work surface 5A extending along the length of the spine wall 2. This allows the work surface 5B to be able to mate with the work surface 5A and thereby create a continuous work surface around at least two walls forming the cubicle 18. The dividing wall 3 as well as the extension wall 4 may be equipped with fittings and/or holders to allow for securing of multiple hanging components. The extension wall 4 can also be configured in various ways to add utility and make it unique, including connecting a storage component, such as a file cabinet (not shown herein), thereto. The dividing wall 3 is shown with a mounting with a window 23 positioned therein allowing persons in the cubicle on either side of the dividing wall 3 to view therethrough. From this figure, two overhead storage units 7, which are adjustable in width, are shown attached to the spine wall 2.

FIG. 4 illustrates a configuration of the dividing wall able to provide additional support for stabilizing the dividing wall 3. The additional support is provided by a leg 12 extending below the dividing wall 3 as well as a C shaped-clamping connector 16 positioned between the leg 12 and the dividing wall 3. The leg 12 is permanently attached to the C shaped-clamping connector 16. The C shaped-clamping connector is releasably secured to the work surface 5A and the dividing wall 3, the work surface being positioned between the leg of the C shaped-clamping connector 16 and the dividing wall 3. Once the work surface 5A is positioned between the legs of the C-clamp 16, the dividing wall 3 is held in a stable position atop the work surface and the leg provides additional support for both the work surface and dividing wall 3 thereby adding stability to the newly created cubicle.

Figure 5:
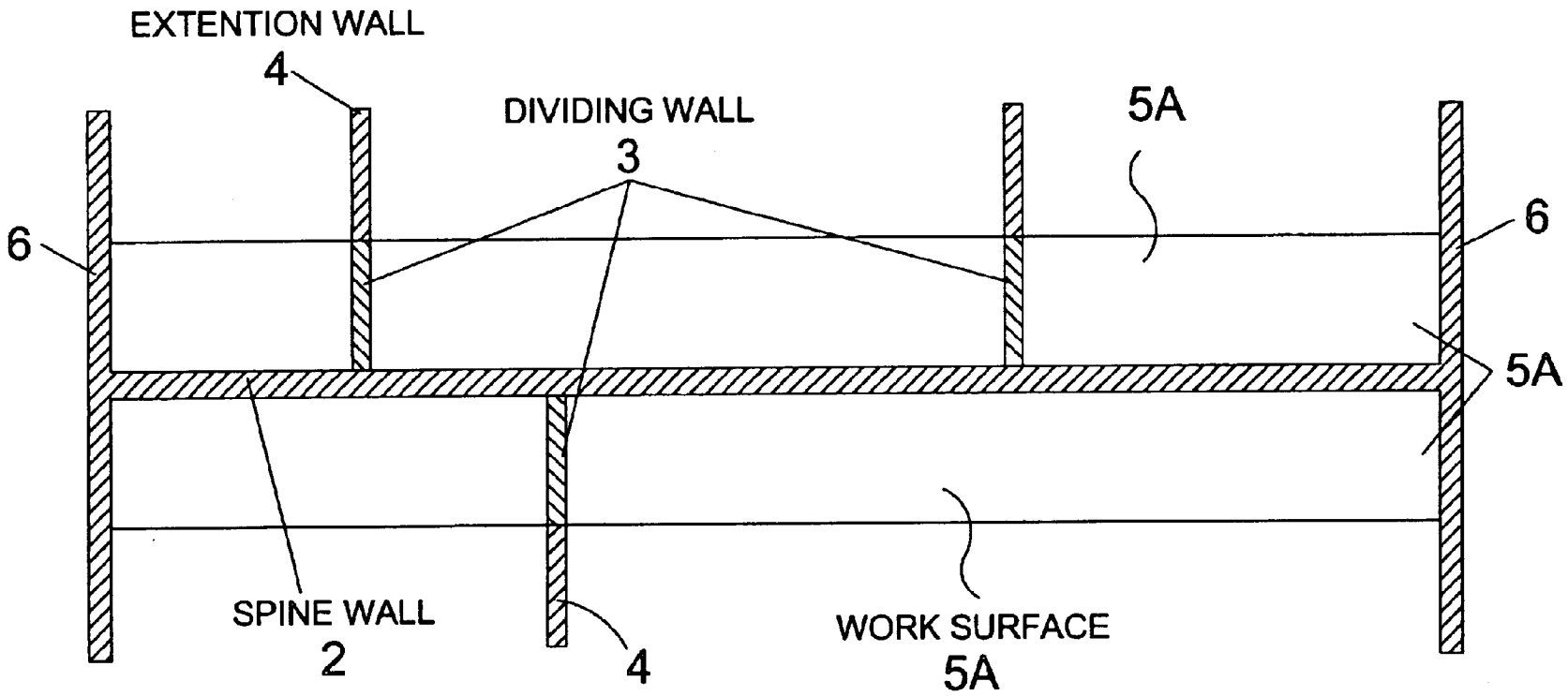
FIG. 5 is a top view of the adjustable cubicle system of the present invention illustrating a plurality of cubicles of different size.

A top side view of the adjustable cubicle system 1 of the present invention is illustrated in FIG. 5. As can be seen from this figure, the system includes the spine wall 2 positioned between two end walls 6. The work surface 5A extends along substantially the entire length of the spine wall 2 and a work surface 5A is positioned on either side of the spine wall 2. Positioned atop each of the work surfaces 5A are dividing walls 3. The dividing walls 3 are positioned to define cubicle dimensions of the adjustable cubicle system 1. As can be seen from the figure, a single dividing wall 3 is positioned on one side of the spine wall 2 to divide the side of the spine wall 2 into two cubicles. As can be seen, the size of the cubicles are not the same and are determined only by the position of the dividing wall 3 along the length of the spine wall 2. Once the desired size is obtained, the dividing wall 3 is releasably secured to the spine wall 2. Positioned on an edge of the dividing wall 3 opposite the connection to the spine wall 2 is an extension wall 4. The extension wall 4 further defines the area of each cubicle on either side thereof. On the opposite side of the spine wall 2 are two dividing walls 3 for forming three cubicles. As shown in this figure, the cubicles do not have to be of the same size. The size of the cubicles can be changed by releasing the dividing walls 3 from their attachment to the spine wall 2 and sliding the dividing walls 3 along the work surface 5A for attachment at any point along the length of the spine wall 2.

Figure 6:
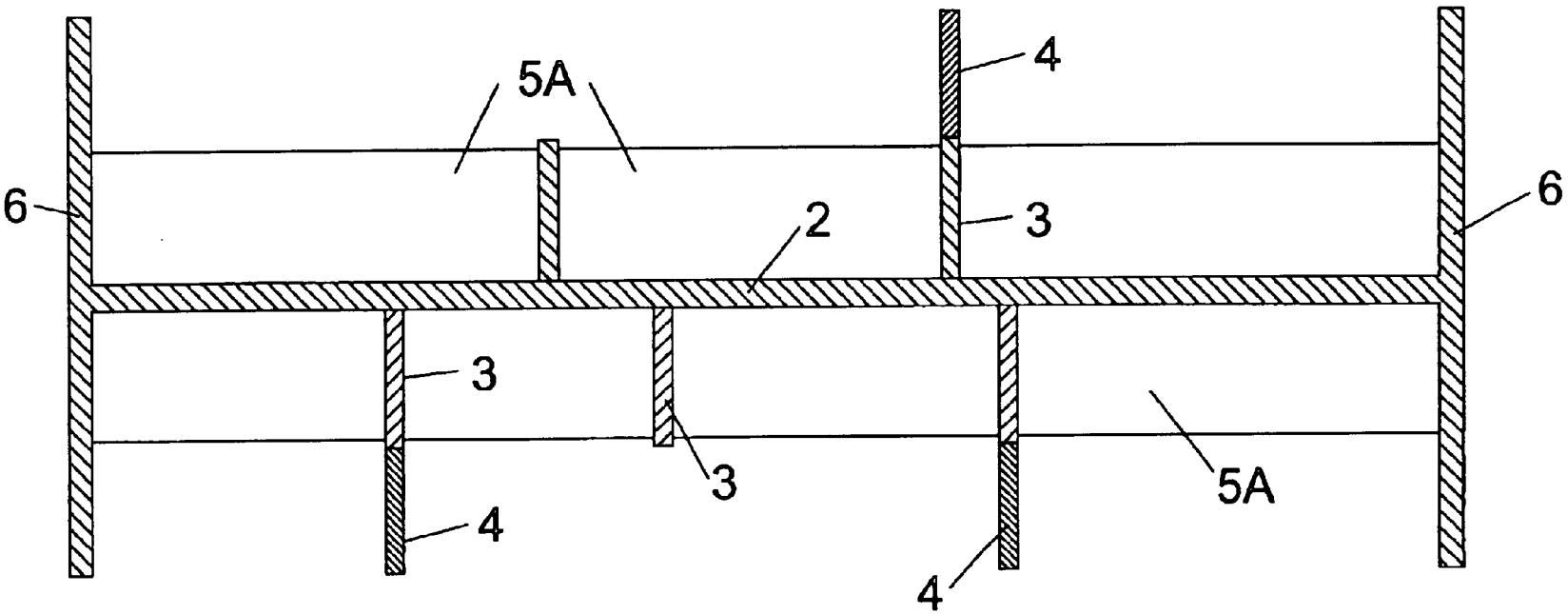
FIG. 6 is a top view of the adjustable cubicle system of the present invention illustrating a plurality of cubicles of different size, wherein extension walls are positioned at an edge of desired dividing walls.

FIG. 6 illustrates a similar view to that of FIG. 5 including additional dividing walls 3 and extension walls 4. This figure illustrates an alternate configuration for the adjustable cubicle system 1. In practice, any number of dividing walls 3 may be used to divide the adjustable cubicle system 1 into any desired number of cubicles of any desired size. The dividing wall 3 and the extension wall 4 located on respective sides of the spine wall 2 can be moved independently from each other to have different size cubicles on the two sides of the spine wall 2.

Figure 7:
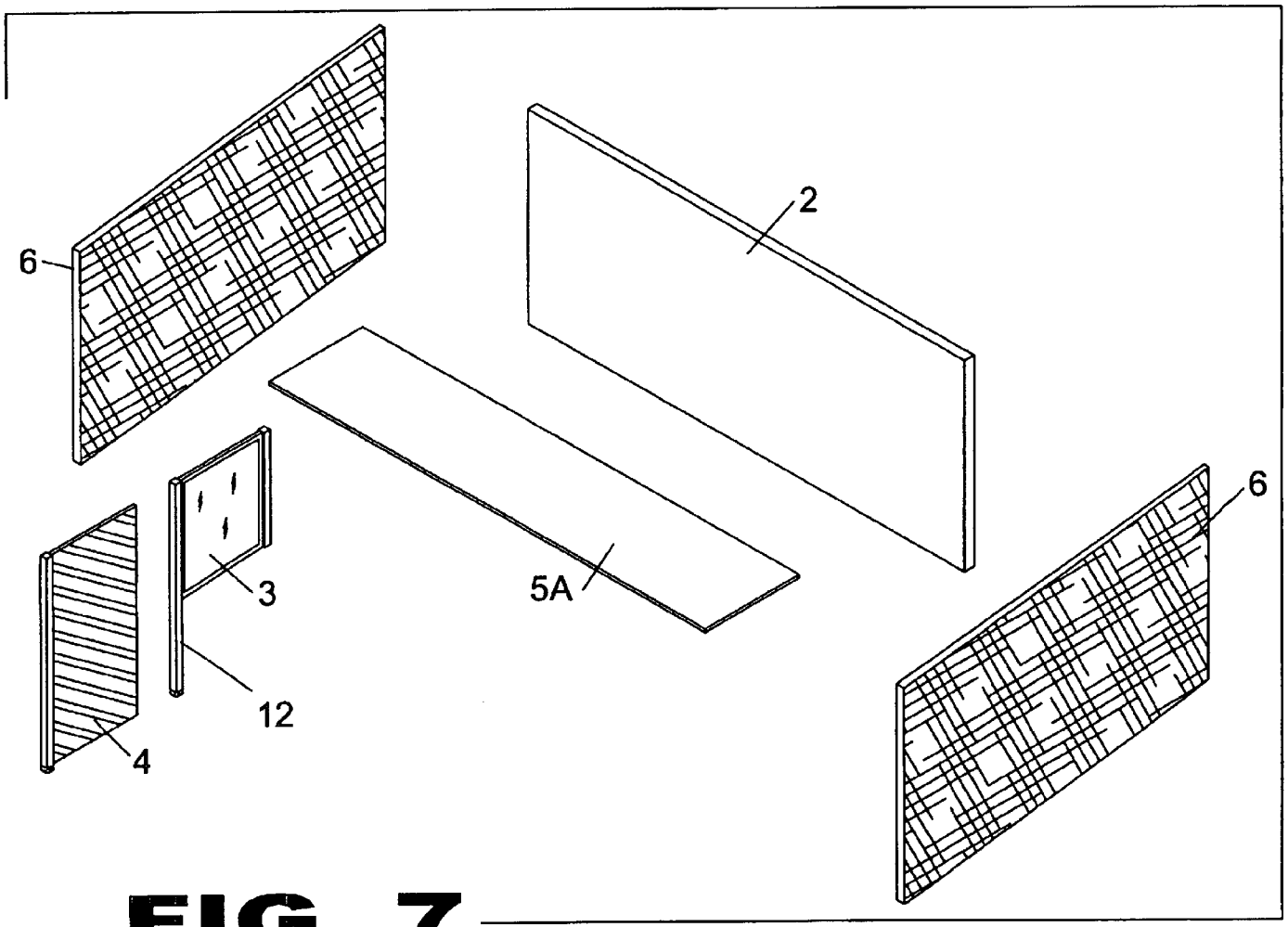
FIG. 7 is an exploded perspective view of the adjustable cubicle system of the present invention.

An exploded view of the adjustable cubicle system 1 of the present invention is illustrated in FIG. 7. As can be seen from this figure, the adjustable cubicle system includes in its most basic form the center spine 2, two end walls 6, a work surface 5A, a dividing wall 3 and an extension wall 4. The spine wall 2 is positioned to extend vertically from a floor surface on which the system 1 is positioned. On either side of the spine wall 2 are first and second end walls 6. The end walls 6 extend vertically from the floor surface and are positioned to be perpendicular to the spine wall 2. The end walls 6 are further releasably connected to the spine wall 2, preferably at a midpoint of the end walls 6 thereby forming the shape of a capital "I". Connected to the spine wall 2 at a desired height above the floor surface is the work surface 5A. The work surface 5A is secured along one edge to the spine wall 2 and preferably extends substantially parallel to the floor surface. The work surface 5A is a continuous surface having a length substantially equal to the length of the spine wall 2. Alternatively, the work surface 5A may be formed from a number of individual sections secured together to form a continuous surface as described with specific reference to FIGS. 11 and 11A. The dividing wall 3 is positioned with a surface thereof atop the work surface 5A and an edge against the spine wall 2. The dividing wall 3 is releasably connected to the spine wall 2 along the edge. A leg 12 extends from the dividing wall 3 on an edge of the dividing wall 3 opposite the connection to the spine wall 2. The leg 12 extends below the work surface 5A and contacts the floor surface thereby providing additional support for the dividing wall 3. Optionally positioned at and releasably connected to the edge of the dividing wall 3 from which the leg 12 extends is the extension wall 4. The extension wall 4 provides an additional wall for further defining the area of the cubicles on either side thereof. Any desired number of dividing walls 3 and extension walls 4 may be connected to the spine wall 2 at any desired position to create any number of cubicles of any desired size with each adjustable cubicle system 1.

Figure 8:
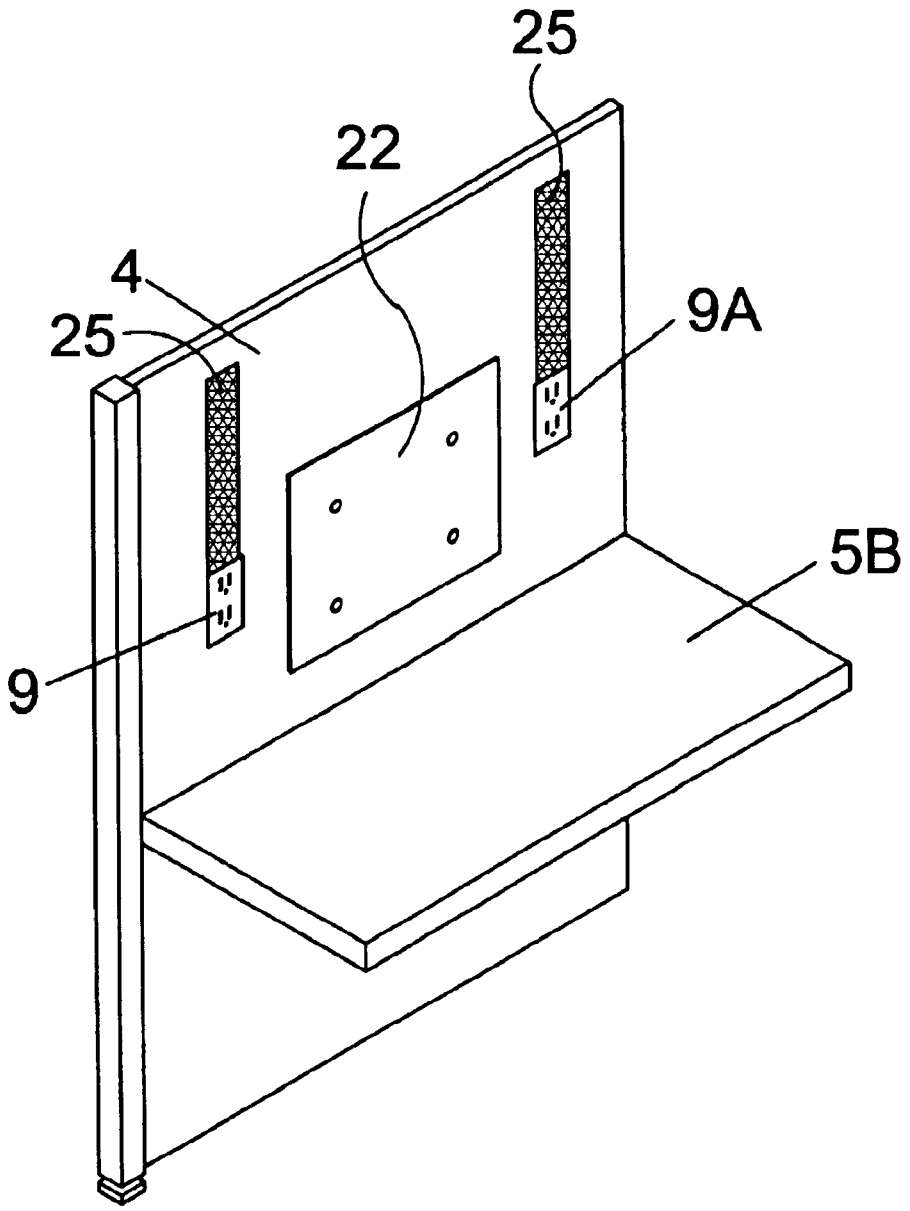
FIG. 8 is a perspective view of an extension wall for use with the adjustable cubicle system of the present invention.

A perspective view of an extension wall 4 is illustrated in FIG. 8. As can be seen from this view, the extension wall 4 includes a work surface 5B extending therefrom. The work surface 5B is preferably at a height above the floor surface substantially equal to the height at which the work surface 5A secured to the spine wall 2 sits. Thus, the work surface 5B is able to mate evenly with the work surface 5A to create an "L" shaped work surface within a cubicle. This extension wall 4 is shown including electrical outlets 9 and data outlets 9A arranged therein as well as a panel 22 for receiving a display screen. Cables for connecting the display screen to a computer processor within the cubicle may extend through an inside of the extension wall 4. Alternatively, a raceway as shown in FIGS. 1 and 2 positioned on the underside of the work surface 5A may be positioned on an underside of the work surface 5B of the extension wall 4. Additionally, wires for providing electricity for the electrical outlets 9 may also extend through an inside of the extension wall 4. Optionally included in extension wall 4 are light fixtures 25. These light fixtures 25 are used to increase light within the cubicle and are specifically directed towards improved facial visibility during video conferencing. Within each extension wall 4 there are four light fixtures 25, two light fixtures direct light to a first side of the extension wall 4 whereas two other light fixtures direct light to a second side of the extension wall 4. The light fixtures 25 may be adapted to direct light as desired to provide the optimum lighting for the desired purpose, e.g. general lighting of the cubicle, lighting for video conferencing, etc.

Figure 8A:
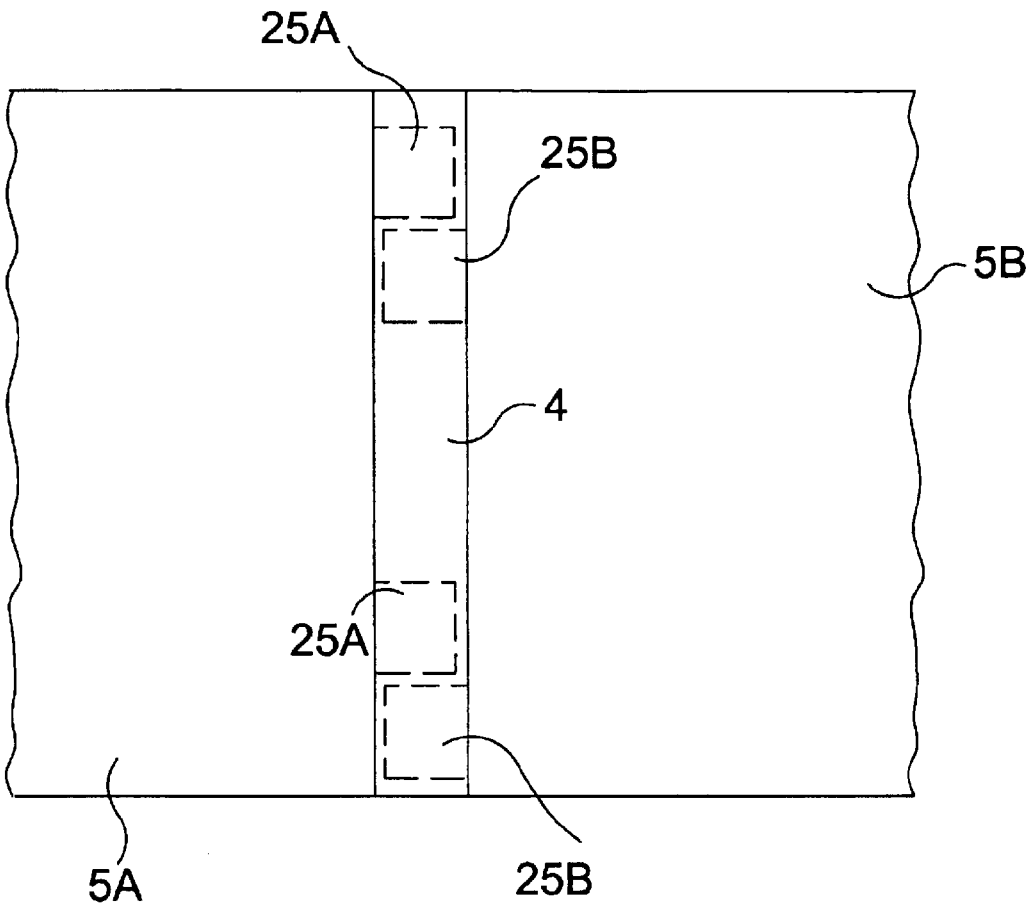
FIG. 8A is a top cross-sectional plan view of the extension wall of the adjustable cubicle system of the present invention illustrated in FIG. 8.

FIG. 8A is a top cross sectional view of the extension wall 4 connected to the work surface 5A. Contained within the extension wall 4 are two sets of light fixtures 25. A first set of light fixtures 25A direct light to a first cubicle. A second set of light fixtures 25B direct light to a second cubicle on a side of the extension wall opposite the first set of light fixtures 25A.

Figure 9:
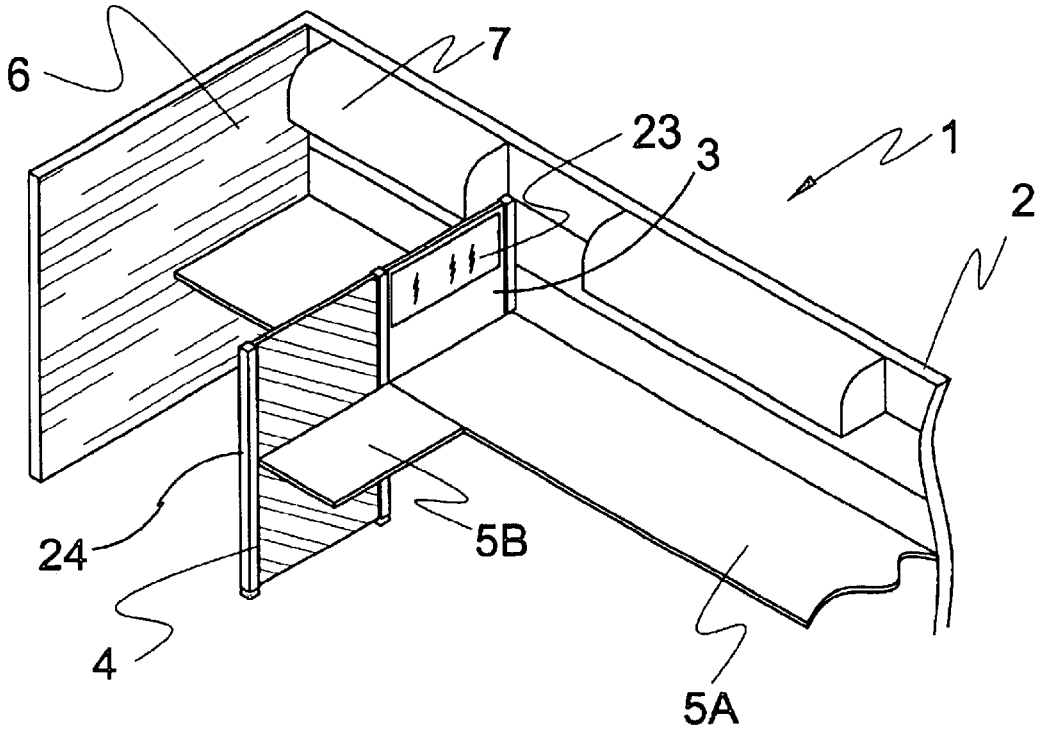
FIG. 9 is a perspective view of cubicle formed by the adjustable cubicle system of the present invention including an extension wall positioned at an edge of a dividing wall, the extension wall storing a screen in an end thereof.

FIG. 9 illustrates a cubicle system similar to those shown in FIGS. 1–6. From this Figure, the spine wall 2 is shown including the work surface 5A extending therealong. The dividing wall 3 is positioned to produce two cubicles, one on either side of the dividing wall 3. The first cubicle 16 is defined by the dividing wall 3 as well as one of the end walls 6. The extension wall 4 is positioned on an edge of the dividing wall 3 to further separate and define the dimensions of the two cubicles. On a side of the extension wall 4 facing a second 18 of the two cubicles is a worksurface 5B. The work surface 5B is preferably positioned a height equal to the height of the work surface 5A extending along the length of the spine wall 2. This allows the work surface 5B to be able to mate with the work surface 5A and thereby create a continuous work surface around at least two walls forming the cubicle 18. Another work surface may be positioned on the opposite side of the extension wall 4 to increase the work area within the first cubicle. The dividing wall 3 as well as the extension wall 4 may be equipped with fittings and/or holders to allow for securing of multiple hanging components. The dividing wall 3 is shown with a window 23 positioned therein allowing persons in the cubicle on either side of the dividing wall 3 to view therethrough. In this embodiment, the extension wall 4 includes a compartment 24 for storage of a retractable screen. When retracted as shown in FIG. 9, the extension wall 4 helps to define the dimensions of the cubicles on either side thereof. Releasably secured to the spine wall are compartments 7 provided for storage. The size of these compartments 7 may be adjusted as will be described hereinafter with specific reference to FIG. 12.

Figure 10:
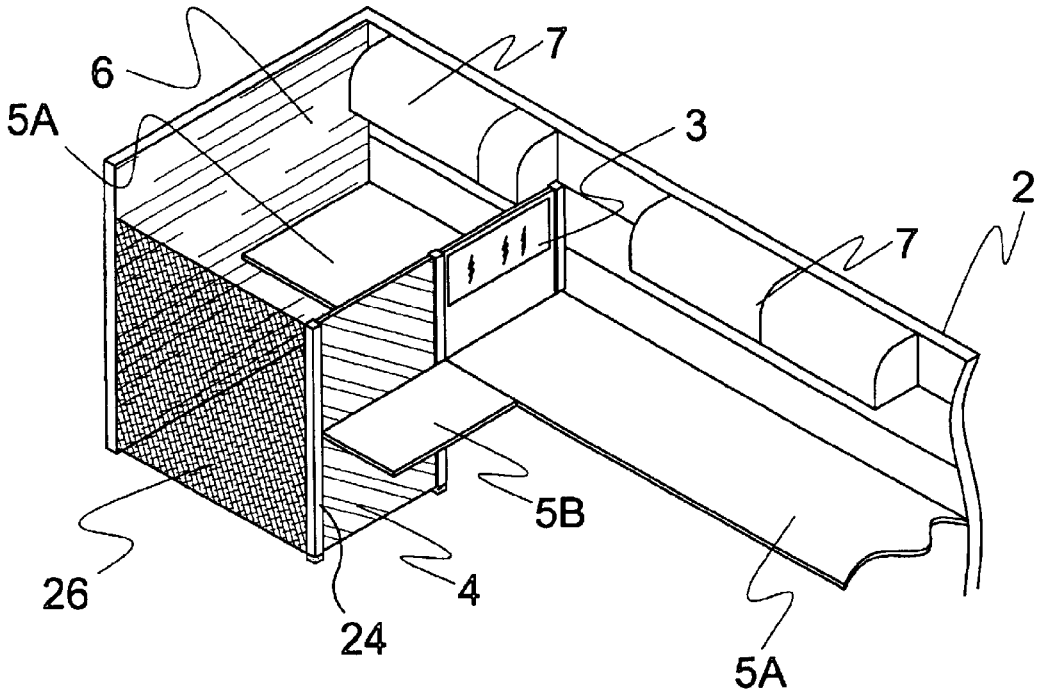
FIG. 10 is a perspective view of the cubicle formed by the adjustable cubicle system of the present invention as shown in FIG. 9 wherein the screen stored within the extension wall is in an extended position to close off a cubicle area.

FIG. 10 illustrates the retractable screen 26 in an extended position. In this position, the screen 26 is able to enclose a cubicle thereby providing privacy to a user of the cubicle or an enclosed storage area. In its extended position, the screen 26 is releasably secured to an edge of the end wall 6 or of any adjacent extension wall 4 or dividing wall 3.

Figure 10A:
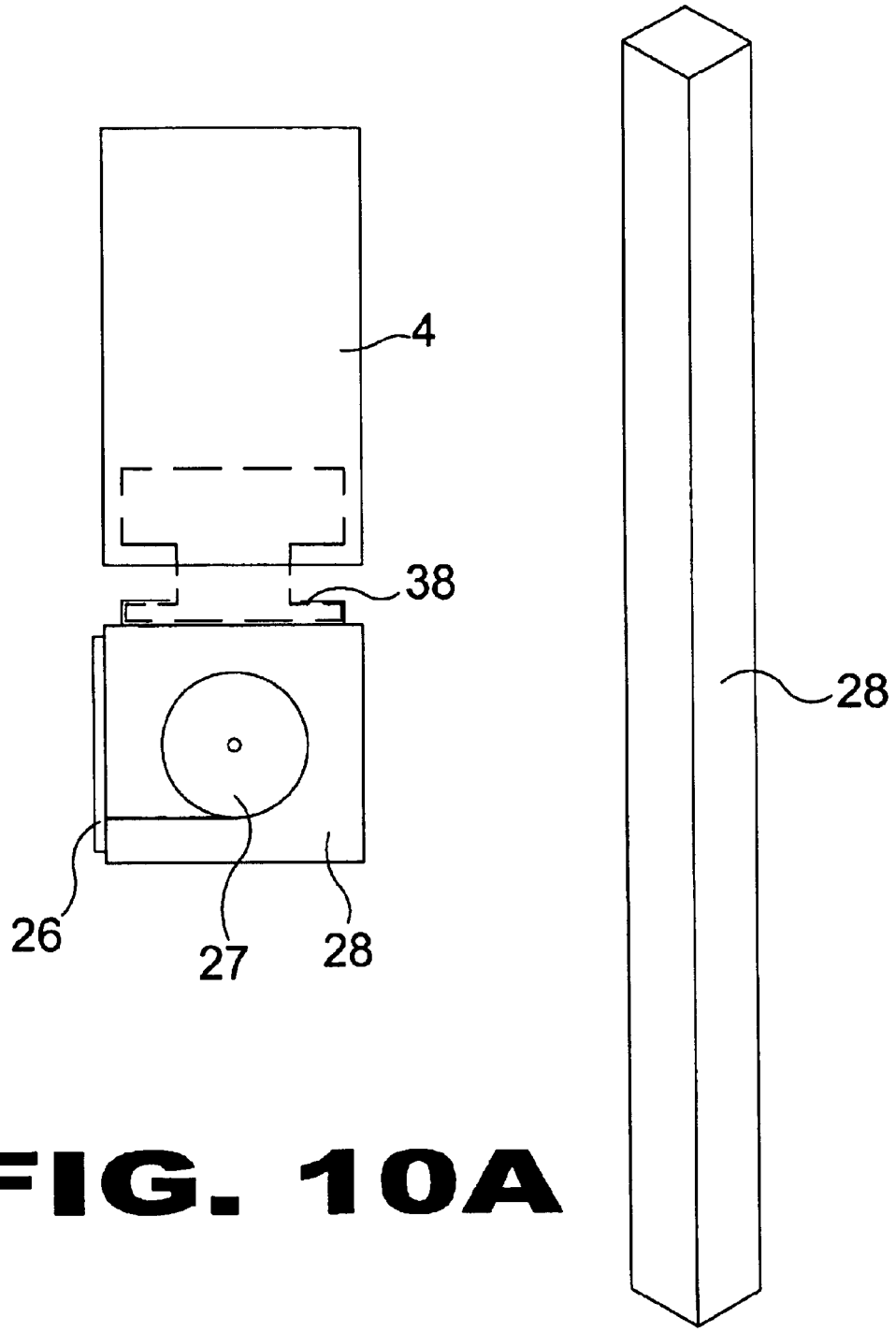
FIG. 10A is a top view of the retractable screen for use with the adjustable cubicle system of the present invention wherein the screen is stored within extension wall.

FIG. 10A shows a top cross sectional view of the retractable screen 26. The screen 26 is connected to extension wall 4 via a connection device 38. Screen 26 is shown in its retracted position contained within a housing 28. When so desired a user may take the screen 26 and extend it outward to another extension wall 4 whereby it will be received and form a closed in portion of a cubicle.

Figure 11:
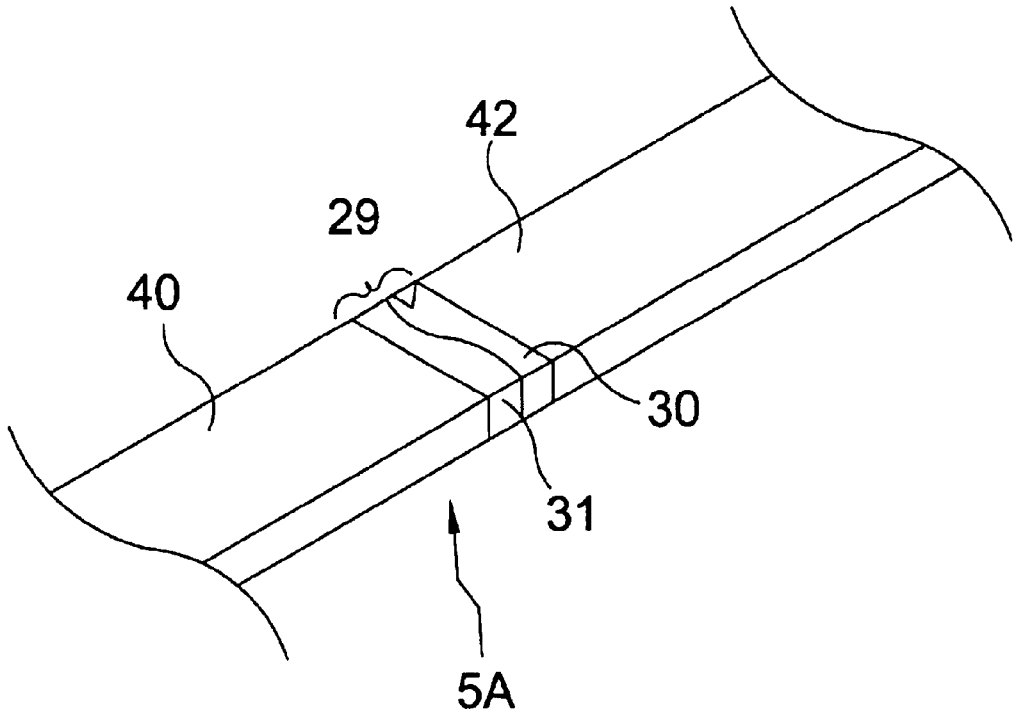
FIG. 11 is a top perspective view of the work surface of the adjustable cubicle system of the present invention whereby two work surface pieces are connected to each other to form a single work surface.
Figure 11A:
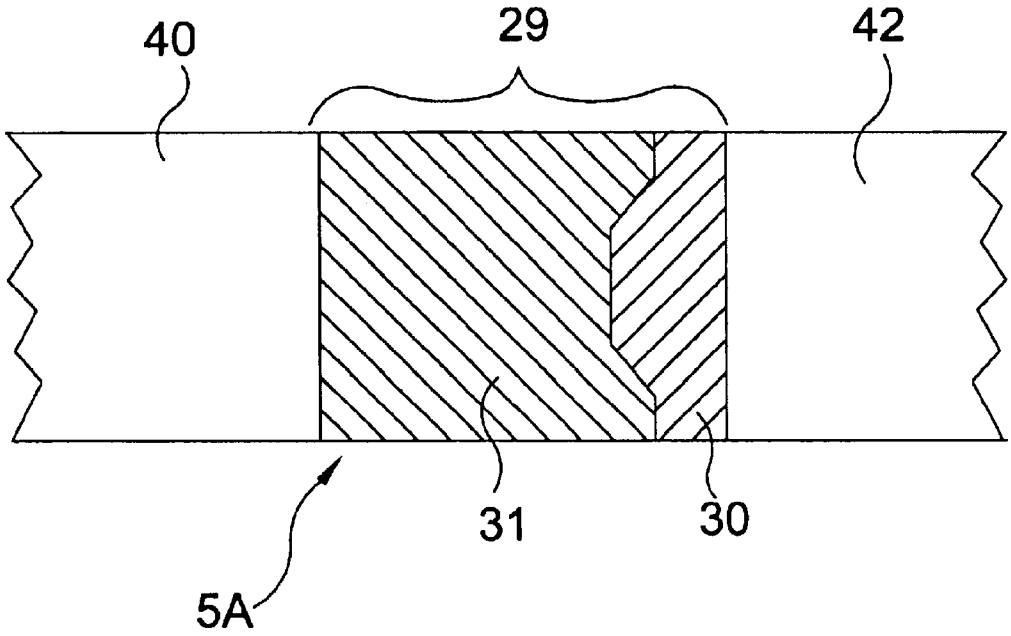
FIG. 11A is a cross-sectional view of the work surface of the adjustable cubicle system of the present invention shown in FIG. 11.

FIGS. 11 and 11A are perspective and cross-sectional views, respectfully, of the work surface formed by a first work section 40 connected to a second work section 42. The first work surface 40 is connected to the second work surface 42 by a beveled edge joint 29. Preferably, either end of both the first and second work surfaces are complementary in shape and non-handed. The first work section 40 has a recessed portion 30 cut in one end thereof. The second work section 42 includes an extension 31 protruding from an end thereof. The protrusion 31 of the second work section 42 is received by the recessed portion 30 of the first work section 40 to form a continuous surface. The first and second work sections each have a first side having a recessed portion 30 and a side opposite thereof having a protrusion 31 for mating with a work portion on either side to form the continuous work surface 5A. Alternatively, the first and second work sections may be formed with flat, finished edges which mate together to form a smooth continuous work surface.

Figure 12:
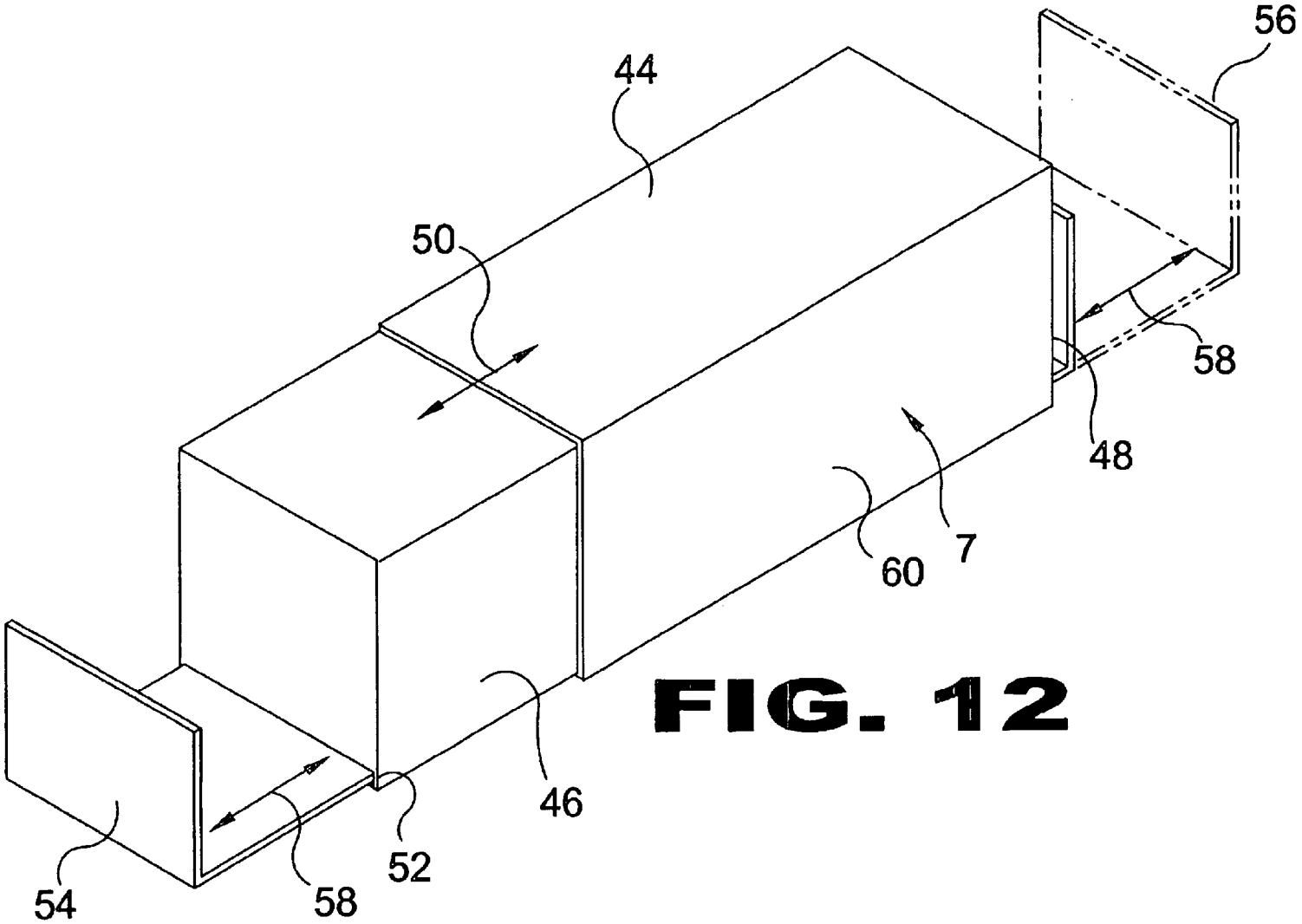
FIG. 12 is perspective view of an adjustable overhead storage cabinet that releasably attaches to the spine wall of the adjustable cubicle system of the present invention.

FIG. 12 is a perspective view of the storage cabinet 7. The storage cabinet 7 is adjustable in size and can be attached to the spine wall 2 of the adjustable cubicle system 1. The storage cabinet 7 includes a main section 44. The main section is hollow and first and second end sections 46 and 48 are telescopically positioned on either end thereof. The first and second end sections have a diameter smaller than the main section 44 thereby allowing the first and second end sections 46 and 48 to slide into and out of the main section to thereby increase or decrease the size of the storage cabinet 7 as indicated by the arrow identified by the reference numeral 50. The first and second end sections 46 and 48 each include a recess 52 on a side opposite the connection to the main section 44. First and second shelves 54 and 56 are movably positioned within the respective recess 52. The shelves 54 and 56 are movable between a first retracted position and a second extended position as indicated by the arrow identified by the reference numeral 58. In the extended position the shelves are able to provide increased shelving space for retaining supplies and the like thereon. When the storage cabinet 7 is attached to the spine wall 2, a user can selectively determine the size of the storage cabinet 7 by movement of the end sections 46 and 48 and sliding the shelves 54 and 56 out from each side of the storage cabinet 7 to adjust to the length of the storage cabinet 7 to fit within the cubicle previously defined by positioning of dividing wall 3 along the work surface 5A of the cubicle system 1. A user can access items in the storage cabinet 7 and end section 46 via a door 60 pivotally connected to the main section 44 and telescoping the desired length of end section 46.

Figure 13:
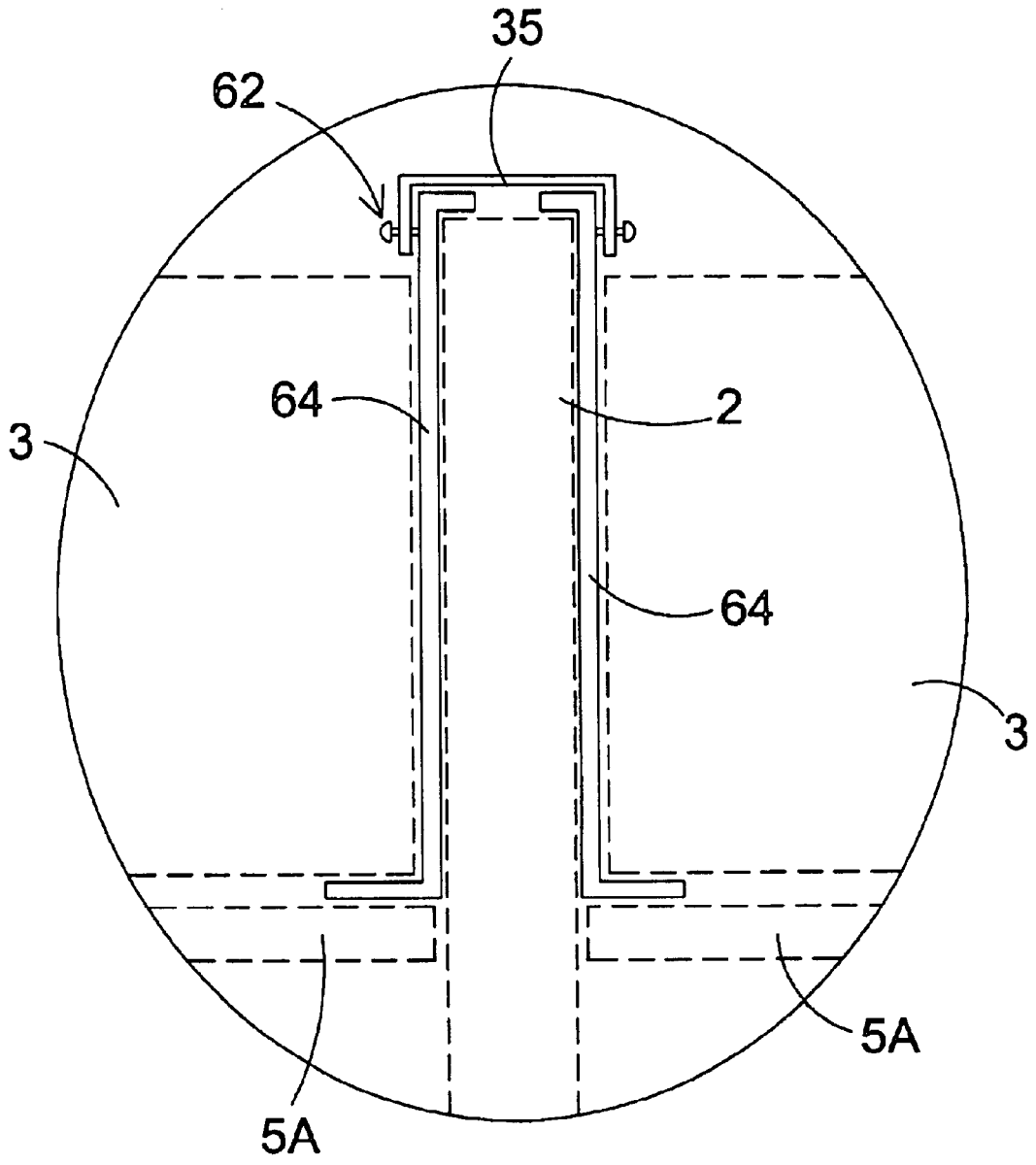
FIG. 13 illustrates an adapter clamp for attachment to conventional cubicle systems and adapting the conventional systems for use with the elements of the adjustable cubicle system of the present invention.

FIG. 13 is a cross sectional view of a conventional cubicle system showing an adapter 62 to adapt the conventional system for use with the components of the cubicle system of the present invention. Positioned on either side of the spine wall 2 are connection devices 64. Positioned atop the spine wall 2 and connecting the two connection devices is a compression clamp 35. The adapter 62 is able to connect with the dividing walls 3 of the cubicle system of the present invention. The dividing walls 3 of the adjustable cubicle system of the present invention can now be releasably secured at any position of the existing spine wall 2 as long as the adapter 62 is moved therewith to create cubicles of any desired size.

Figure 14:
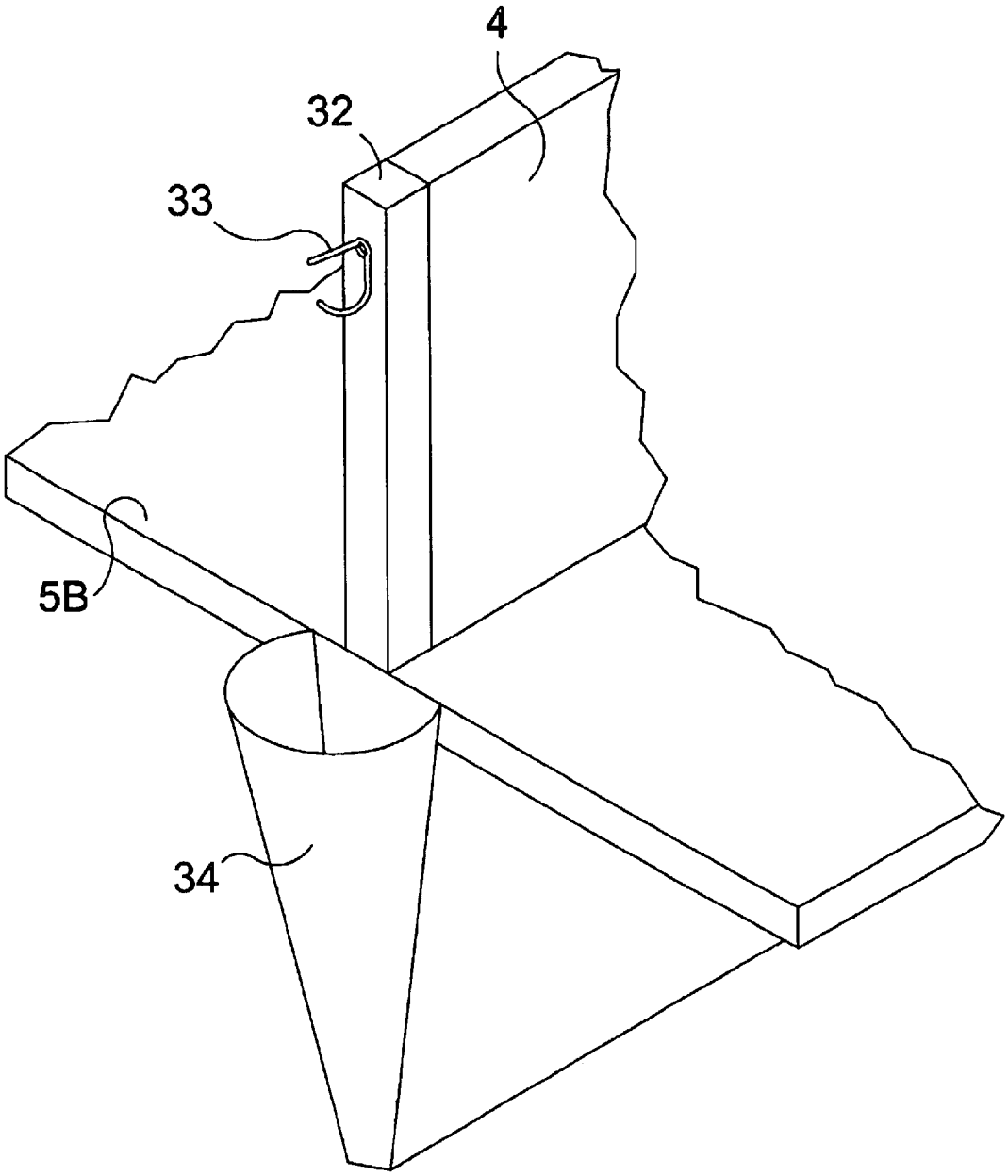
FIG. 14 illustrates a vertical storage attachment for the extension wall of the adjustable cubicle system of the present invention.

FIG. 14 is a prospective view of a vertical storage module 32 that attaches to an end of the extension wall 4. The vertical storage module 32 has a hook 33 to accommodate a coat, bag, or anything of the like that can be hung thereon. The vertical storage module 32 also contains an umbrella receptacle 34 for neatly storing an umbrella and thereby prevent the umbrella from getting underfoot.

The assembly and operation of the adjustable cubicle system 1 will now be described with reference to the figures. In order to assemble the adjustable cubicle system 1 an area in which the system is to be assembled must be selected. Upon selection of an area, the spine wall 2 is positioned in a center of the area and extending vertically from the floor surface on which the system 1 is to be positioned. On either side of the spine wall 2 first and second end walls 6 are connected. The end walls 6 extend vertically from the floor surface and are positioned to be perpendicular to the spine wall 2. The end walls 6 are further releasably connected to the spine wall 2, preferably at a midpoint of the end walls 6 thereby forming the shape of a capital "I". Connected to one and possibly both sides of the spine wall 2 at a desired height above the floor surface is the work area 5A. The work surface 5A is secured along one of its edges to the spine wall 2 and preferably extends substantially parallel to the floor surface. The work surface 5A is a continuous surface having a length substantially equal to the length of the spine wall 2. The dividing wall 3 is then positioned with a surface thereof atop the work surface 5A and an edge against the spine wall 2. The dividing wall 3 is releasably connected to the spine wall 2 along the edge whereby the dividing wall 3 is positioned to extend parallel to both the end walls 6 and perpendicular to the spine wall 2. The leg 12 extending from the dividing wall 3 extends on a side of the work surface 5A opposite the spine wall 2. The leg 12 contacts the floor surface thereby providing additional support for the dividing wall 3. The extension wall 4 is optionally positioned at and releasably connected to the edge of the dividing wall 3 from which the leg 12 extends. The extension wall 4 provides an additional wall for defining the area of the cubicles on either side thereof. Any desired number of dividing walls 3 and extension walls 4 may be connected to the spine wall 2 in the same manner at any desired position to create any number of cubicles of any desired size with each adjustable cubicle system 1. The Extension wall 4 may include a compartment 24 for retaining a retractable screen 26. The retractable screen may be extended and releasably secured to an adjacent extension wall 4 or an end wall 6 to create an enclosed cubicle useful for creating a private work area or an enclosed storage area.

FIG. 10A shows a top cross sectional view of the retractable screen 26. The screen 26 is connected to extension wall 4 via a connection device 38. Screen 26 is shown in its retracted position contained within a housing 28. When so desired a user may take the screen 26 and extend it outward to another extension wall 4 whereby it will be received and form a closed in portion of a cubicle.

FIGS. 11 and 11A are perspective and cross-sectional views, respectfully, of the work surface formed by a first work section 40 connected to a second work section 42. The first work surface 40 is connected to the second work surface 42 by a beveled edge joint 29. The first work section 40 has a recessed portion 30 cut in a side thereof. The second work section 42 includes an extension 31 protruding from a side thereof. The protrusion 31 is received by the recessed portion 30 to form a continuous surface. The first and second work portions each have a first side having a recessed portion 30 and a side opposite thereof having a protrusion 31 for mating with a work portion on either side to form the continuous work surface 5A.

The cubicle system 1 is now fully functional and can be used by persons as work areas or as storage areas.

From the above description it can be seen that the adjustable cubicle system of the present invention is able to overcome the shortcomings of prior art devices by providing an adjustable cubicle system which is able to provide an easily adjustable system for creating cubicles of any desired and varied sizes within an open area of a workplace without complete dismantling of the already assembled parts and with significantly reduced need to purchase additional parts for reconfiguration. The adjustable cubicle system includes a single work surface extending along a length of a spine wall of the system and at least one dividing panel able to be selectively secured to the spine wall at any desired position therealong, the dividing wall extending perpendicularly to the spine wall. A plurality of dividing panels may be used and are each readily adjusted to produce any desired number of cubicles, each cubicle being of any desired size. The dividing panels are able to selectively slide along the work surface when adjusting a size of a cubicle and attach to the spine wall at any desired location thereon. A work surface may be provided to extend along both sides of the spine wall thereby allowing the formation of cubicles on both sides of the spine wall. The adjustable cubicle system may further include at least one extension wall releasable securable to a dividing wall for increasing a size of the cubicle, the extension wall may also includes a work surface extending therealong and at a height so as to be able to mate with the work surface extending along the spine wall. The extension wall may further include a recess for storing a monitor for connection with a computer processor within an adjacent cubicle. The divider and extension walls may be of a thickness able to provide a passage for cables and wires therethrough to provide electrical outlets within each cubicle formed by the system. A selectively retractable screen may be stored within the extension wall wherein, when in an extended position, the screen is selectively securable to another wall to create an enclosed cubicle providing privacy to a user or storage space. Furthermore, the adjustable cubicle system of the present invention is simple and easier to use and more economical in cost to manufacture than existing systems.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claim:

1. A system for forming individual work areas within an open area, said system comprising:

a) a spine wall extending vertically from a surface of the open area;

b) a first work surface extending along and substantially perpendicular to one side of said spine wall, said first work surface having a length substantially equal to a length of said spine wall;

c) a divider wall positioned atop said first work surface and releasably connected to said spine wall at any point along the length of said spine wall for forming cubicles of desired size; and d) an extension wall releasably connected to said dividing wall for extending an area of cubicles formed on either side of the dividing wall.

2. The system according to claim 1, further comprising a second work surface positioned on a side of said spine wall opposite said first work surface, said second work surface having a length substantially equal to a length of said spine wall.

3. The system of claim 2, further comprising a plurality of dividing walls each of said dividing walls being releasably connected to said spine wall at any point along the length of said spine wall and on either side of said spine wall for forming a plurality of cubicles of desired size on either side of said spine wall wherein each side of the spine wall is independent of the other.

4. The system of claim 3, further comprising a plurality of extension walls, each extension wall being releasably connected to a respective one of said plurality of dividing walls for extending an area of cubicles formed on either side of said respective extension wall.

5. The system according to claim 3, wherein said plurality of dividing walls each include means for releasably connecting an edge thereof to said spine wall.

6. The system according to claim 5, wherein said plurality of dividing walls each further include a leg extending therefrom on a side opposite said connecting means, said leg extending below said respective one of said first and second work surfaces and against a floor surface of the open area for providing additional support to said system.

7. The system of claim 2, further comprising an extension wall releasably connected to said dividing wall for extending an area of cubicles formed on either side of the dividing wall.

8. The system of claim 7, wherein each of said plurality of extension walls includes a work surface extending therefrom, said work surface being at a height equal to a height of said first work surface.

9. The system of claim 7, wherein respective ones of said plurality of extension walls include a compartment and a retractable screen, wherein said retractable screen is movable between a first position housed within said compartment and a second extended position being releasably connected to one of said first end wall, said second end wall and an adjacent extension wall for enclosing a cubicle area formed by said system.

10. The system according to claim 1, further comprising first and second end walls positioned on opposite ends of said spine wall and extending perpendicular to said spine wall for providing additional support to said spine wall.

11. The system of claim 1, further comprising a plurality of dividing walls each of said dividing walls being releasably connected to said spine wall at any point along the length of said spine wall for forming a plurality of cubicles of desired size.

12. The system of claim 11, further comprising a plurality of extension walls, each extension wall being releasably connected to a respective one of said plurality of dividing walls for extending an area of cubicles formed on either side of said respective extension wall.

13. The system according to claim 11, wherein said extension wall is able to receive wires and cables therethrough and includes an electrical outlet therein for providing power to an electrical device within a cubicle formed by the system, the wires extending through said extension wall providing power to said electrical outlet.

14. The system of claim 1, wherein said extension wall includes a work surface extending therefrom, said work surface being at a height equal to a height of said first work surface.

15. The system of claim 1, wherein said extension wall includes a compartment and a retractable screen, wherein said retractable screen is movable between a first position housed within said compartment and a second extended position being releasably connected to one of said first and second end walls for enclosing a cubicle area formed by said system.

16. The system according to claim 1, wherein said dividing wall includes means for releasably connecting an edge thereof to said spine wall.

17. The system according to claim 16, wherein said dividing wall further includes a leg extending therefrom on a side opposite said connecting means, said leg extending below said first work surface and against a floor surface of the open area for providing additional support to said system.

18. The system according to claim 17, wherein said dividing wall further includes a C shaped clamp connected between said dividing wall and said leg, said C shaped clamp positioned to receive said work surface therein for providing added stability to said dividing wall.

19. The system according to claim 1, wherein said spine wall includes means for releasably connecting fixtures thereto.

20. The system according to claim 1, further comprising a runway extending along an underside of said work surface for receiving cables and wires therein thereby providing data signals and power to cubicles formed by the system.

21. The system according to claim 1, further comprising a runway extending along an underside of said work surface for receiving cables and wires therein thereby providing data signals and power to said extension wall.

22. The system according to claim 1, wherein the work surface is formed by first and second work sections mated together to form a continuous work surface.

23. The system according to claim 22, wherein each of the first and second work sections include first and second serpintine ends, said first end of said first work section mating with said second end of said second work section.

24. The system according to claim 23, wherein said first end of both said first and second work sections include a recessed portion extending along a length thereof and said second end of both said first and second work sections include a protrusion extending along a length thereof, said protrusion of said second work section being received by said recess in said first work section.

25. The system according to claim 1, further comprising a cabinet releasably secured to said spine wall.

26. The system according to claim 25, wherein said cabinet includes first and second telescoping sections to adjust a length of said cabinet based upon a size of a cubicle in which it is positioned.

27. The system according to claim 26, wherein at least one of said first and second telescoping sections include a recess on a side thereof and said cabinet further comprises at least one ledge moveably extending from said recess in a respective one of said first and second telescoping sections to provide a length adjustable shelf within said cubicle.

28. A system for forming individual work areas within an open area, said system comprising:

a) a spine wall extending vertically from a surface of the open area;

b) a first work surface extending along and substantially perpendicular to one side of said spine wall, said first work surface having a length substantially equal to a length of said spine wall;

c) a divider wall positioned atop said first work surface and releasably connected to said spine wall at any point along the length of said spine wall for forming cubicles of desired size; and d) a support member extending between said dividing wall and the surface of the open area for providing additional support to said system.

29. The system according to claim 28, wherein said support member is a leg.

* * * * *